US011299889B2

(12) United States Patent
Ng

(10) Patent No.: US 11,299,889 B2
(45) Date of Patent: Apr. 12, 2022

(54) DECK PANEL AND FASTENING SYSTEM

(71) Applicant: Pre-Insulated Metal Technologies, Inc., Vacaville, CA (US)

(72) Inventor: Brian Ng, Hercules, CA (US)

(73) Assignee: Pre-Insulated Metal Technologies, Inc., Vacaville, CA (US)

( * ) Notice: Subject to any disclaimer, the term of this patent is extended or adjusted under 35 U.S.C. 154(b) by 0 days.

(21) Appl. No.: 16/717,197

(22) Filed: Dec. 17, 2019

(65) Prior Publication Data

US 2021/0180326 A1 Jun. 17, 2021

(51) Int. Cl.

| | |
|---|---|
| ***E04D 1/00*** | (2006.01) |
| ***E04D 5/14*** | (2006.01) |
| ***E04D 1/28*** | (2006.01) |
| ***E04D 3/35*** | (2006.01) |

(52) U.S. Cl.

CPC ..... *E04D 1/29* (2019.08); *E04D 1/28* (2013.01); *E04D 3/352* (2013.01); *E04D 5/144* (2013.01); *E04D 5/148* (2013.01); *E04D 3/355* (2013.01)

(58) Field of Classification Search

CPC ..... E04D 1/29; E04D 1/2914; E04D 1/2916; E04D 1/2918; E04D 1/28; E04D 5/144; E04D 5/148; E04D 3/35; E04D 3/351; E04D 3/352; E04D 3/355

See application file for complete search history.

(56) References Cited

U.S. PATENT DOCUMENTS

| | | | | |
|---|---|---|---|---|
| 4,382,353 | A * | 5/1983 | Kelly | E04D 1/365 52/309.5 |
| 4,575,981 | A * | 3/1986 | Porter | E04D 3/355 52/309.9 |
| 4,700,520 | A * | 10/1987 | Ting | E04C 2/292 52/478 |
| 5,934,855 | A * | 8/1999 | Osterle | E04D 3/3603 405/302.1 |
| 6,004,645 | A * | 12/1999 | Hubbard | B32B 27/08 428/57 |
| 6,233,889 | B1 * | 5/2001 | Hulsey | E04D 3/3603 411/533 |
| 6,282,858 | B1 * | 9/2001 | Swick | E04D 1/2916 52/533 |
| 7,841,148 | B2 * | 11/2010 | Tonyan | E04B 7/20 52/483.1 |
| 8,065,852 | B2 * | 11/2011 | Tonyan | E04B 7/20 52/745.13 |
| 2003/0163959 | A1 * | 9/2003 | Deming | B29C 63/02 52/90.2 |

(Continued)

FOREIGN PATENT DOCUMENTS

DE 102008016345 A1 * 10/2009 ..... E04D 3/358

*Primary Examiner* — Theodore V Adamos

(74) *Attorney, Agent, or Firm* — Harness, Dickey & Pierce, P.L.C.

(57) ABSTRACT

A roof deck (20) has plurality of insulated panels (22) secured together by a first plurality of fasteners (54) along their longitudinal edges (28, 29). Additionally, the panels (22) are secured by a second plurality of fasteners (56), transverse to the longitudinal axis (26), to a framework (18). A plurality of washers (60) disperse the force of the second plurality of fasteners (56). The plurality of washers (60) are secured to each of the second plurality of fasteners (56). A membrane (24) covers the roof deck (20).

20 Claims, 5 Drawing Sheets

(56) References Cited

U.S. PATENT DOCUMENTS

| | | | | |
|---|---|---|---|---|
| 2007/0175170 | A1* | 8/2007 | Shah | E04D 5/145 52/741.1 |
| 2008/0000176 | A1* | 1/2008 | Mandelzys | E04D 3/352 52/272 |
| 2009/0025335 | A1* | 1/2009 | Flynn | E04F 13/0889 52/792.11 |
| 2011/0041443 | A1* | 2/2011 | Tonyan | E04B 5/10 52/483.1 |
| 2017/0058523 | A1* | 3/2017 | Kennedy | E04D 11/02 |

* cited by examiner

DECK PANEL AND FASTENING SYSTEM

FIELD

The present disclosure relates to roof panels and, more particularly, to fastening systems to secure insulated roof panels to framework or trusses.

BACKGROUND

In traditional commercial roofing systems, the roof includes a metal deck with stacked insulation and a membrane bonded to the insulation. This is a labor-intensive system and necessitates multiple trades to apply the roof. Additionally, each portion of the roof is supplied by and covered by a different vendor. Thus, the multi-layered roof with a metal deck, multiple layers of rigid installation and a covering membrane is time-consuming to construct and install onto a building.

Thus, it would be desirable to provide a roof system that enables fast installation without on-site rigid foam application. Additionally, it would be desirable to have a roofing system that eliminates multiple installations and the involved labor.

SUMMARY

According to the present disclosure, a roof deck system is provided that enable easy installation of a single roof panel. The roof decking provides fast installation while eliminating multiple contractors. Further, the roof deck provides a diaphragm shear resistance and wind uplift.

According to the present disclosure, a roof deck fastening system comprises a plurality of roof panels. Each roof panel has an inner skin and an outer skin. An insulation layer is bonded between the inner and outer skins. Each roof panel defines a longitudinal axis and mating longitudinal edges. Adjacent roof panels mate together along the longitudinal edges. A first plurality of fasteners secures the adjacent roof panels together with one another along the longitudinal edges. The first plurality of fasteners are spaced from one another along the longitudinal edges at a distance apart from about four to 24 inches on center. A second plurality of fasteners secures the plurality of roof panels to a frame or truss. The second plurality of fasteners are spaced from each other, transverse to the longitudinal axis, at a distance apart from one another of about six to 10 inches on center. A plurality of washers are positioned on each of the second plurality of fasteners. The plurality of washers each have a diameter of about a half inch to three inches. A membrane covers the plurality of roof panels. The roof decking provides a diaphragm shear of 717 to 1903 PLF.

The first plurality of fasteners are spaced at about four to 24 inches on center. The second plurality of fasteners are spaced at about four to 10 inches on center. A third plurality of fasteners secures the longitudinal edge of each of the plurality of roof panels onto the frame or truss. The third plurality of fasteners is in line with the second plurality of fasteners, thus, transverse to the longitudinal axis. The washers may have a circular or polygonal configuration. The membrane is adhered or optionally mechanically secured to the outer skin.

According to a second aspect of the disclosure, a building structure comprises a frame having a roof deck and a plurality of side walls enclosing sides of the frame. The roof deck includes a plurality of roof panels. Each roof panel has an inner skin and an outer skin. An insulation layer is bonded between the inner and outer skins. Each roof panel defines a longitudinal axis and mating longitudinal edges. Adjacent roof panels mate together along the longitudinal edges. A first plurality of fasteners secures the adjacent roof panels together with one another along the longitudinal edges. The first plurality of fasteners are spaced from one another along the longitudinal edges at a distance apart from about four to 10 inches on center. A second plurality of fasteners secures the plurality of roof panels to a frame or truss. The second plurality of fasteners are spaced from each other, transverse to the longitudinal axis, at a distance apart from one another of about four to 10 inches on center. A plurality of washers are positioned on each of the second plurality of fasteners. The plurality of washers each have a diameter of about a half inch to three inches. A membrane covers the plurality of roof panels. The roof decking provides a diaphragm shear of 717 to 1903 PLF.

The first plurality of fasteners are spaced at about four to 24 inches on center. The second plurality of fasteners are spaced at about four to 10 inches on center. A third plurality of fasteners secures the longitudinal edge of each of the plurality of roof panels onto the frame or truss. The third plurality of fasteners is in line with the second plurality of fasteners, thus, transverse to the longitudinal axis. The washers may have a circular or polygonal configuration. The membrane is adhered or optionally mechanically secured to the outer skin.

Accordingly, to the third aspect of the disclosure, a roof deck comprises a plurality of roof panels. Each roof panel has an inner skin and an outer skin. An insulation layer is bonded between the inner and outer skins. Each roof panel defines a longitudinal axis and mating longitudinal edges. Adjacent roof panels mate together along the longitudinal edges. A first plurality of fasteners secures the adjacent roof panels together with one another along the longitudinal edges. The first plurality of fasteners are spaced from one another along the longitudinal edges at a distance apart from about four to 24 inches on center. A second plurality of fasteners secures the plurality of roof panels to a frame or truss. The second plurality of fasteners are spaced from each other, transverse to the longitudinal axis, at a distance apart from one another of about four to 10 inches on center. A plurality of washers are positioned on each of the second plurality of fasteners. The plurality of washers each have a diameter of about a half inch to three inches. A membrane covers the plurality of roof panels. The roof decking provides a diaphragm shear of 717 to 1903 PLF.

The first plurality of fasteners are spaced at about four to 24 inches on center. The second plurality of fasteners are spaced at about four to 10 inches on center. A third plurality of fasteners secures the longitudinal edge of each of the plurality of roof panels onto the frame or truss. The third plurality of fasteners is in line with the second plurality of fasteners, thus, transverse to the longitudinal axis. The washers may have a circular or polygonal configuration. The membrane is adhered or optionally mechanically secured to the outer skin.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

DETAILED DESCRIPTION OF THE PREFERRED EMBODIMENT

Figure 1:
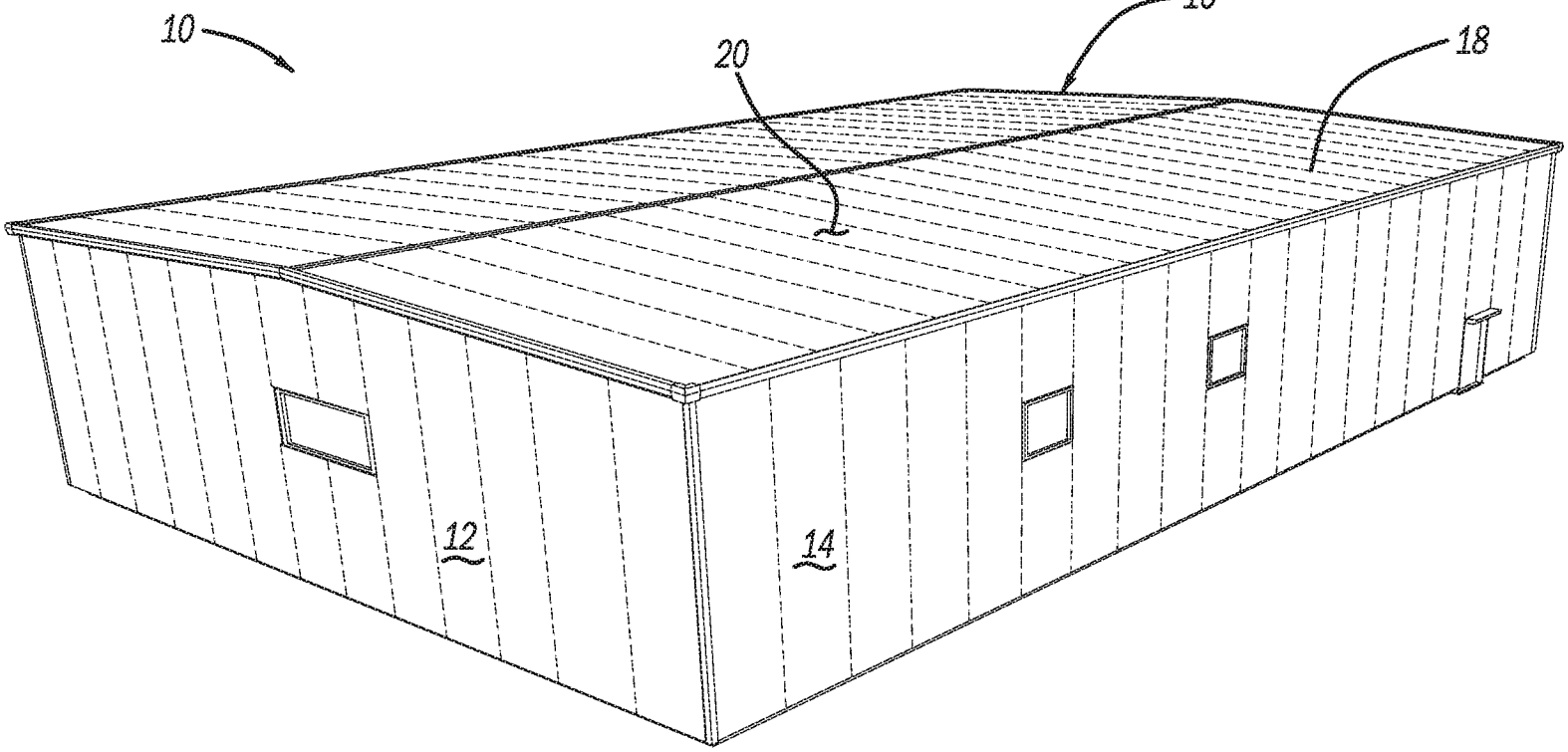
FIG. 1 is a perspective view of a building including the roof deck in accordance with the present disclosure.

Example embodiments will now be described more fully with reference to the accompanying drawings. Corresponding reference numerals indicate corresponding parts reference to the accompanying drawings.

Turning to the Figures, particularly FIG. 1, a building is illustrated designated with the reference numeral 10. The building 10 includes side walls 12 as well as front and rear walls 14. A roof 16 is positioned above and secured with the wall 12, 14. A framing system 18 is shown in phantom. The framing system 18 is preferably steel.

The roof 16 includes a roof deck 20. The roof deck 20 is formed from a plurality of panels 22 that are secured together as explained herein. Additionally, a waterproof membrane 24 is adhesively or mechanically secured on the exterior surface of the plurality of panels 22 to provide a waterproof seal for the roof 16.

Figure 2:
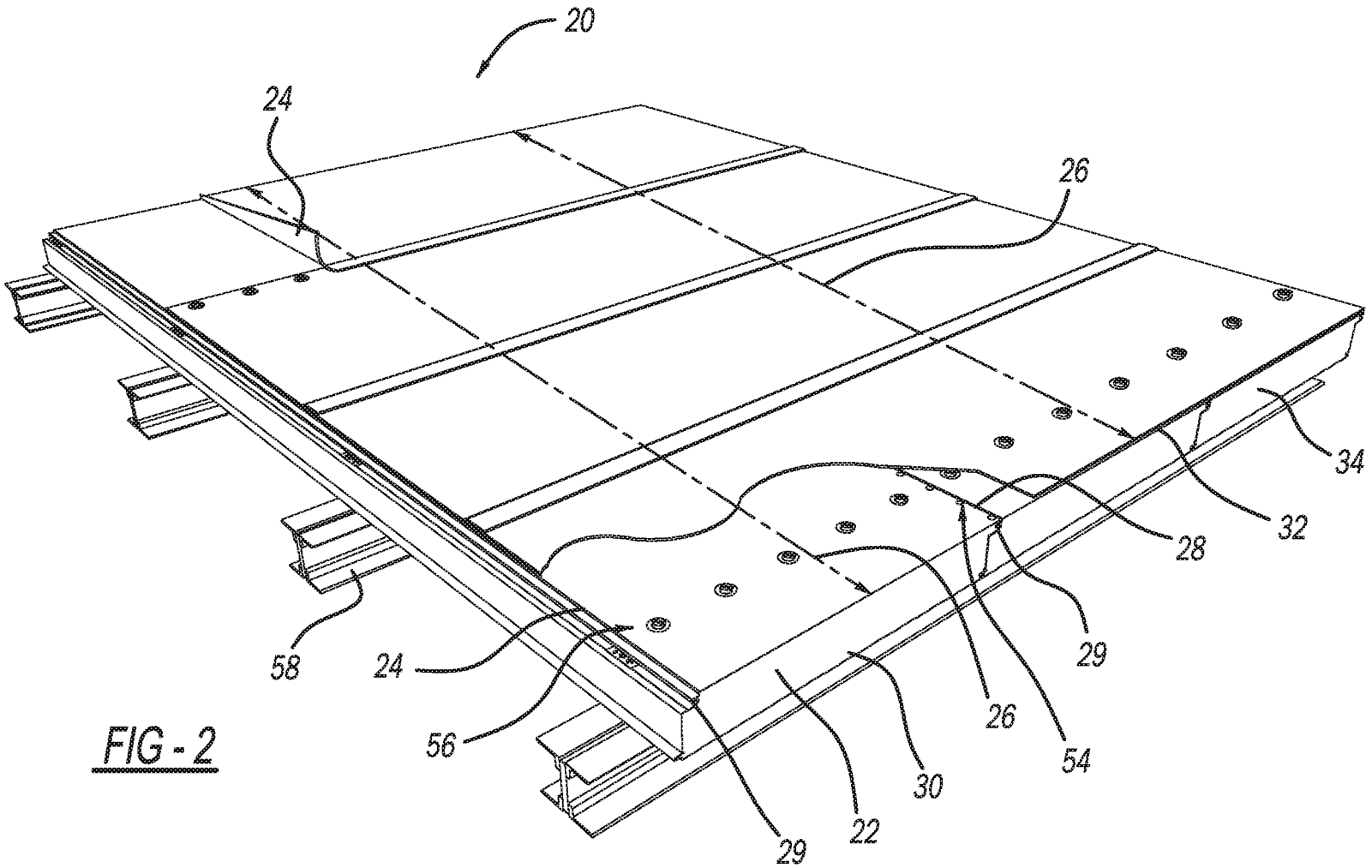
FIG. 2 is a perspective view of a roof deck prior to the addition of the membrane.

Turning to FIG. 2, a plurality of panels 22 are illustrated with the membrane 24 removed. Each panel 22 defines a longitudinal axis 26. The panel 22 includes longitudinal edges 28 and 29. The longitudinal edges 28 and 29 mate with longitudinal edges 29, 28, respectively, of the adjacent panels 22.

Figure 3:
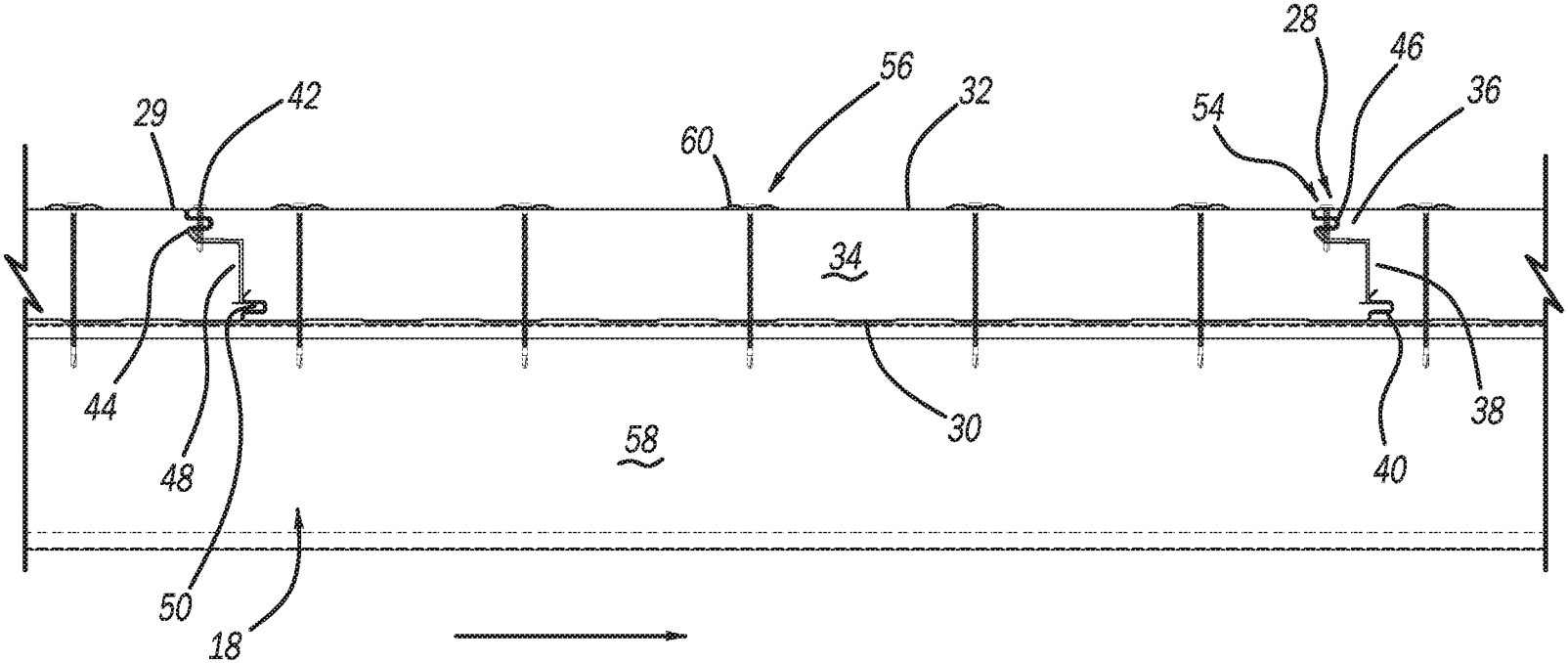
FIG. 3 is a cross-section view of FIG. 2 along line 2-2 thereof.
Figure 4:
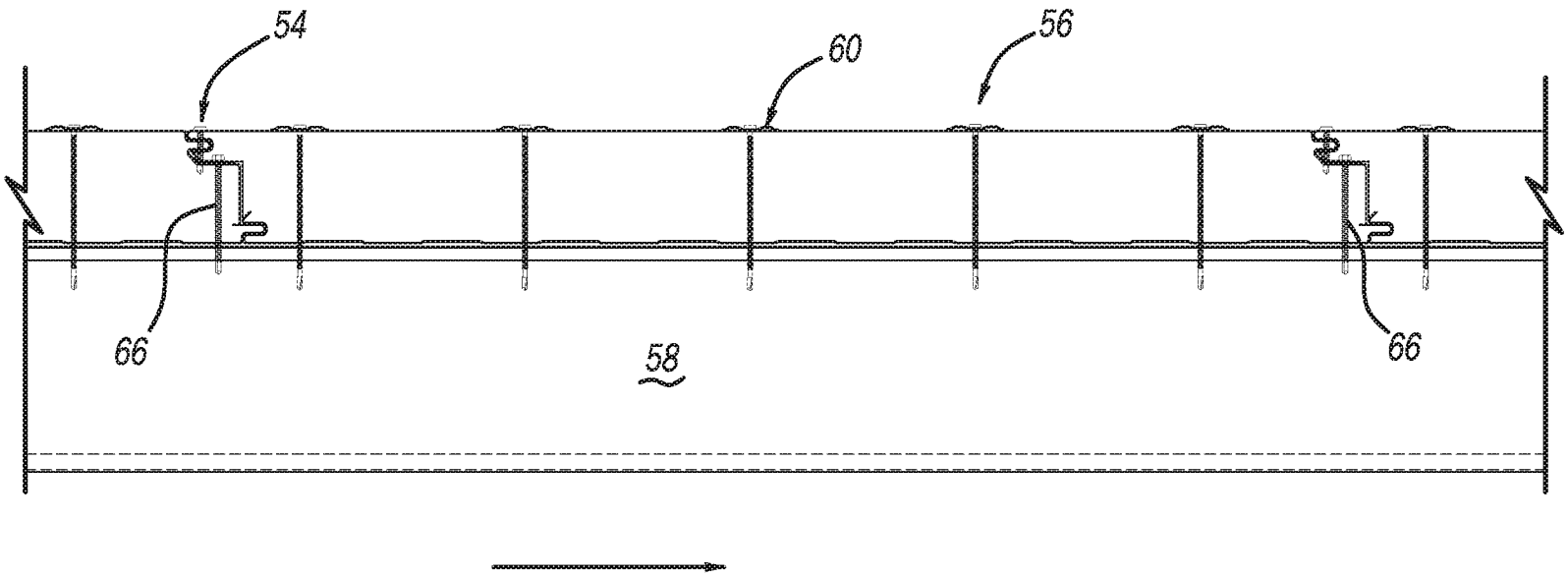
FIG. 4 is an additional cross-section view like that of FIG. 3.

Each panel 22 include an inner skin 30 and an outer skin 32. An insulation body 34 is bonded between the inner 30 and outer skin 32. The edge 28 includes a projecting flange 36 and a cutout portion 38. The protective flange 36 includes a recess 46. The cutout portion 38 includes a recess 40. This longitudinal edge 28 mates with an adjoining panel opposite longitudinal edge 29. The longitudinal edge 29 includes a cutout portion 42 with a projection 44. The projection 44 inserts into the recess 46 of flange 36. A projecting portion 48 is stepped from the cutout portion 42. The projecting portion 48 includes a projection 50. The projection 50 mates with the recess 40. Thus, longitudinal edges 28 and 29 mate with one another as illustrated in FIGS. 3 and 4.

A first plurality of fasteners 54 is secured along the longitudinal edges 28 and 29. Each fastener 54 passes through the projecting portion 36 and projection 44 to secure the longitudinal edges 28, 29 of the panels 22 with one another. The first plurality of fasteners 54 are generally spaced at a distance between four to 29, and preferably four to 24 inches on center, with respect to one another. This holds and secures the edges with one another.

A second set of fasteners 56 pass through the panels 22 to secure the panels with a truss 58 of the framework 18. Each fastener 56 includes a washer 60 to provide force distribution of the fastener 56 passing through the panels 22. The washers 60 can be disc-shaped with a circular or polygonal configuration. Each washer 60 includes a hole to enable one of the plurality of fasteners 56 to pass through each washer 60. The washers 60 can have a diameter from a half inch to three inches. This provides a force distribution from the fasteners onto the outer skin of the panel 22. Thus, the fasteners 56 do not countersink into the panels 22.

The second plurality of fasteners 56 are positioned with respect to one another at a distance of from about four to 10, and preferably seven to 9 inches on center. This provides securement of the second plurality of fasteners 56 with the truss 58. This provides for a diaphragm shear of 717 to 1903 PLF. Thus, when the panels 22 are positioned adjacent to one another, fasteners 56 on different panels 22 in the second plurality of fasteners 56 can be at different positions with respect to the longitudinal edge 28; 29. This depends upon the centering of the second plurality of fasteners 56 with respect to one another. Additionally, the second plurality of fasteners 56 are aligned transverse to the longitudinal axis 26 of the panels 22. Thus, the panels 22 can be secured to the trusses 58.

Turning to FIG. 4, an additional embodiment is illustrated. Here, a third plurality of fasteners 66 are positioned into the projections 48 of the panels 22. The third plurality of fasteners 66 pass through the protection 48 and secure to the truss 58. This enhances securement of the panel 22 in place on the truss 58. Additionally, the fasteners 66 provide additional force and increases the diaphragm shear. The third plurality of fasteners 66 are in alignment with the second plurality of fasteners 56, as illustrated in FIG. 4. Additionally, the first plurality of fasteners 54 can be increased in number such that the first plurality of fasteners 54 are positioned with respect to one another at about six inches on center.

The roof deck 20 is constructed by positioning a first panel 22 onto the trusses 58 at a position where the longitudinal edge 28 determines the direction of installation. The second plurality of fasteners 56 is inserted into the roof panel 22 and secured with the truss 58. If needed, or desired, prior to insertion of the second plurality of fasteners 56, the third plurality of fasteners 66 would be inserted into the projection 48. The second panel 22 is positioned adjacent to the first panel 22 with the longitudinal edge 28 mating with the longitudinal edge 29. The second plurality of fasteners is passed through the second panel 22 and secured with the truss 58. The first plurality of fasteners 54 is inserted to secure the longitudinal edges 28, 29 with one another. This is repeated and continued until the roof deck 20 is complete.

Figure 5:
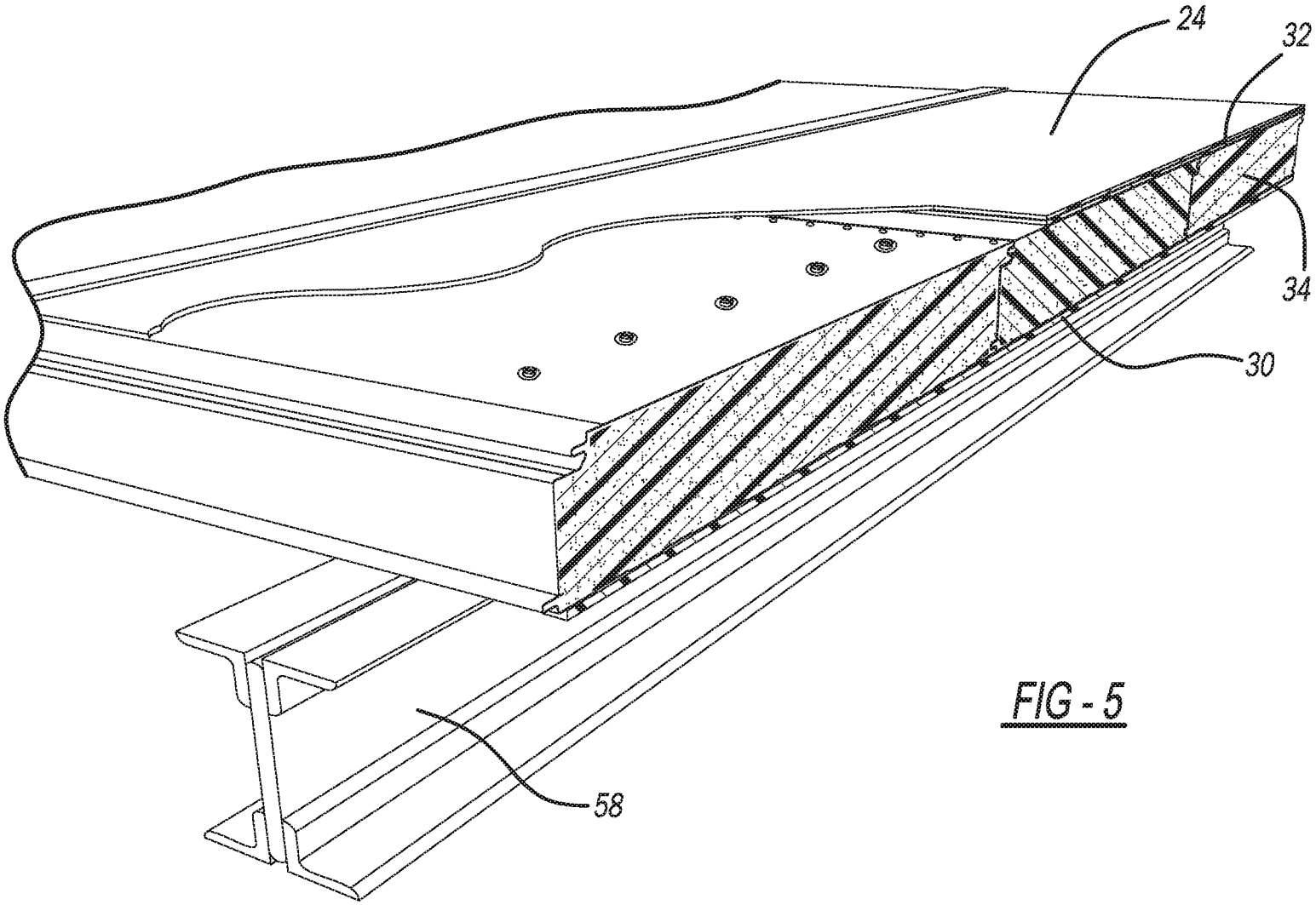
FIG. 5 is a perspective partial cross-section view of the roof deck in accordance with the disclosure.

After the roof deck 20 is complete as illustrated in FIG. 2, the membrane cover 24 is secured with the roof deck 20 as illustrated in FIG. 5. It can be adhesively or mechanically secured to the roof deck 20.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A roof deck fastening system comprising:

a plurality of roof panels, each roof panel having an inner skin and an outer skin manufactured in continuous lengths;

each roof panel comprising an insulation layer between and bonding with the inner and outer skin, each roof panel defining a longitudinal axis, and mating longitudinal edges with a tongue and groove configuration, adjacent roof panels mating together along the tongue and groove longitudinal edges;

a first plurality of fasteners, the first plurality of fasteners securing the adjacent roof panels together along the tongue and groove longitudinal edges to prevent independent movement of the adjacent roof panels with respect to one another, the first plurality of fasteners are spaced from each other along the tongue and groove longitudinal edges at a distance apart from about four to 24 inches on center;

a second plurality of fasteners, the second plurality of fasteners securing the plurality of roof panels directly to and only to a frame or truss forming a roof framework, the second plurality of fasteners are spaced from each other transverse to the longitudinal axis at a distance apart from one another of about four to 10 inches on center;

a plurality of washers, one washer of the plurality is coupled with a respective one of the second plurality of fasteners, the plurality of washers each having a diameter of about one-half inch to about three inches enabling force distribution from the second plurality of fasteners onto the outer skin prohibiting countersinks into the panel;

a membrane covering the plurality of roof panels and the roof deck provides a diaphragm shear of 717 to 1903 PLF due to only being secured directly with the frame or truss.

2. The roof deck fastening system of claim 1 wherein the first plurality of fasteners are spaced at about four to 12 inches on center.

3. The roof deck fastening system of claim 1 wherein the second plurality of fasteners are spaced at about seven to nine inches on center.

4. The roof deck fastening system of claim 1, wherein a third plurality of fasteners secure the longitudinal edge of each of the plurality of roof panels onto the frame or truss, the third plurality of fasteners is aligned with the second plurality of fasteners.

5. The roof deck fastening system of claim 1 wherein the washers have a circular or polygonal configuration.

6. The roof deck fastening system of claim 1 wherein the membrane is adhered to the outer skin.

7. The roof deck fastening system of claim 1 wherein the membrane is mechanically secured to the outer skin.

8. A roof deck comprising:

a plurality of roof panels, each roof panel having an inner skin and an outer skin;

each roof panel comprising an insulation layer between and bonding with the inner and outer skin, each roof panel defining a longitudinal axis, and mating longitudinal edges with a tongue and groove configuration, adjacent roof panels mating together along the tongue and groove longitudinal edges to prevent independent movement of the adjacent roof panels with respect to one another;

a first plurality of fasteners, the first plurality of fasteners securing the adjacent roof panels together along the longitudinal edges, the first plurality of fasteners are spaced from each other along the longitudinal edges at a distance apart from about four to 24 inches on center;

a second plurality of fasteners, the second plurality of fasteners securing the plurality of roof panels directly to and only to a truss forming a roof framework, the second plurality of fasteners are spaced from each other transverse to the longitudinal axis at a distance apart from one another of about four to 10 inches on center;

a plurality of washers, one washer of the plurality is coupled with a respective one of the second plurality of fasteners, the plurality of washers each having a diameter of about one-half inch to about three inches enabling force distribution from the second plurality of fasteners onto the outer skin prohibiting countersinks into the panel;

a membrane covering the plurality of roof panels and the roof deck provides a diaphragm shear of 717 to 1903 PLF due to only being secured directly with the truss.

9. The roof deck of claim 8 wherein the second plurality of fasteners are spaced at about seven to 9 inches on center.

10. The roof deck of claim 8, wherein a third plurality of fasteners secure the longitudinal edge of each of the plurality of roof panels onto the truss, the third plurality of fasteners aligned with the second plurality of fasteners.

11. The roof deck of claim 8 wherein the washers have a circular or polygonal configuration.

12. The roof deck of claim 8 wherein the membrane is adhered to the outer skin.

13. The roof deck fastening system of claim 8 wherein the membrane is mechanically secured to the outer skin.

14. A building structure comprising:

a frame having a roof, a plurality of side walls;

enclosing the frame;

the roof further comprising a plurality of roof panels, each roof panel having an inner skin and an outer skin;

each roof panel comprising an insulation layer between and bonding with the inner and outer skin, each roof panel defining a longitudinal axis and mating longitudinal edges with a tongue and groove configuration, adjacent roof panels mating together along the tongue and groove longitudinal edges;

a first plurality of fasteners, the first plurality of fasteners securing the adjacent roof panels together along the tongue and groove longitudinal edges to prevent independent movement of the adjacent roof panels with respect to one another, the first plurality of fasteners are spaced from each other along the longitudinal edges at a distance apart from about four to 24 inches on center;

a second plurality of fasteners, the second plurality of fasteners securing the plurality of roof panels directly to and only to the frame of the roof forming a roof framework, the second plurality of fasteners are spaced from each other transverse to the longitudinal axis at a distance apart from one another of about four to 10 inches on center;

a plurality of washers, one washer of the plurality is covered with a respective one of the second plurality of fasteners, the plurality of washers each having a diameter of about one-half inch to about three inches enabling force distribution from the second plurality of fasteners onto the outer skin prohibiting countersinks into the panel;

a membrane covering the plurality of roof panels and the roof deck provides a diaphragm shear of 717 to 1903 PLF due to only being secured directly with the frame.

15. The building structure of claim 14 wherein the first plurality of fasteners are spaced at about four to 12 inches on center.

16. The building structure of claim 14 wherein the second plurality of fasteners are spaced at about seven to 9 inches on center.

17. The building structure of claim 14, wherein a third plurality of fasteners secure the longitudinal edge of each of the plurality of roof panels onto the frame of the roof, the third plurality of fasteners is in line with the second plurality of fasteners.

18. The building structure of claim 14 wherein the washers have a circular or polygonal configuration.

19. The building structure of claim 14 wherein the membrane is adhered to the outer skin.

20. The building structure of claim 14 wherein the membrane is mechanically secured to the outer skin.

* * * * *